US008413452B2

(12) United States Patent
Morris et al.

(10) Patent No.: US 8,413,452 B2
(45) Date of Patent: Apr. 9, 2013

(54) LINEAR DRIVE CRYOGENIC REFRIGERATOR

(75) Inventors: Ronald N. Morris, Bedford, MA (US); Bruce R. Andeen, Collierville, TN (US); Allen J. Bartlett, New London, NH (US)

(73) Assignee: Brooks Automation, Inc., Chelmsford, MA (US)

( * ) Notice: Subject to any disclaimer, the term of this patent is extended or adjusted under 35 U.S.C. 154(b) by 284 days.

(21) Appl. No.: 12/950,080

(22) Filed: Nov. 19, 2010

(65) Prior Publication Data

US 2011/0126554 A1 Jun. 2, 2011

Related U.S. Application Data

(63) Continuation of application No. PCT/US2009/044632, filed on May 20, 2009.

(60) Provisional application No. 61/128,380, filed on May 21, 2008.

(51) Int. Cl.
*F25B 9/00* (2006.01)

(52) U.S. Cl. ..... 62/6; 62/51.1

(58) Field of Classification Search ..... 62/6, 51.1, 62/510, 513; 417/417, 415, 570
See application file for complete search history.

(56) References Cited

U.S. PATENT DOCUMENTS 3,220,201 A 11/1965 Heuchling et al.
3,315,490 A 4/1967 Berry et al.
3,365,896 A 1/1968 Berry
3,640,082 A 2/1972 Dehne
3,774,405 A 11/1973 Leo
4,036,027 A 7/1977 Bamberg
4,118,943 A 10/1978 Chellis
(Continued)

FOREIGN PATENT DOCUMENTS

CN 88201396 U 12/1988
CN 1800748 A 7/2006
(Continued)

OTHER PUBLICATIONS

Notification of Transmittal of the International Search Report and the Written Opinion of the International Searching Authority for Int'l Application No. PCT/US2009/044632; Date Mailed: Jan. 12, 2010.

*Primary Examiner* — Mohammad Ali
(74) *Attorney, Agent, or Firm* — Hamilton, Brook, Smith & Reynolds, P.C.

(57) ABSTRACT

A cryogenic refrigerator has a refrigeration cylinder and at least two displacers. Each displacer reciprocates in the refrigeration cylinder and moves refrigeration gas through the refrigeration cylinder. A regenerator cools the refrigeration gas, and gas control valves admit high pressure gas into the refrigeration cylinder and exhaust gas from the refrigeration cylinder. The refrigerator also has linear motors operatively connected to displacers, and the linear motors drive the displacers in reciprocating movement. A position sensor is provided to determine a parameter of the displacers during reciprocation. A controller is operatively connected to the linear motors to control the linear motors. The controller controls a parameter of the two displacers during reciprocation. The parameter can be stroke length, stroke speed, stroke phase or another parameter of the displacer for temperature control of the cryogenic refrigerator. The cryogenic refrigerator may also include a device to remove vibration.

41 Claims, 5 Drawing Sheets

U.S. PATENT DOCUMENTS 4,294,077 A 10/1981 Sarcia
4,294,600 A 10/1981 Sarcia et al.
4,481,777 A 11/1984 Sarcia
4,520,630 A 6/1985 Sarcia
4,543,793 A 10/1985 Chellis et al.
4,545,209 A 10/1985 Young
4,578,956 A 4/1986 Young
4,584,839 A 4/1986 Jensen et al.
4,664,685 A 5/1987 Young
4,679,401 A * 7/1987 Lessard et al. ..... 62/55.5
4,761,960 A 8/1988 Higham et al.
4,783,968 A 11/1988 Higham et al.
4,840,043 A 6/1989 Sakitani et al.
4,951,471 A 8/1990 Sakatani et al.
5,018,357 A 5/1991 Livingstone et al.
5,056,319 A 10/1991 Strasser
5,088,288 A 2/1992 Katagishi et al.
5,309,722 A * 5/1994 Phillips, Jr. ..... 62/49.1
5,361,588 A 11/1994 Asami et al.
5,386,708 A * 2/1995 Kishorenath et al. ..... 62/55.5
5,398,512 A 3/1995 Inaguchi et al.
5,471,841 A * 12/1995 Inaguchi ..... 62/6
5,482,919 A 1/1996 Joshi
5,483,802 A * 1/1996 Kawajiri et al. ..... 62/6
5,513,498 A * 5/1996 Ackermann et al. ..... 62/51.1
5,582,017 A * 12/1996 Noji et al. ..... 62/55.5
5,583,472 A * 12/1996 Moritsu et al. ..... 335/216
5,593,517 A * 1/1997 Saito et al. ..... 148/301
5,613,367 A * 3/1997 Chen ..... 62/47.1
5,647,217 A 7/1997 Penswick et al.
5,647,218 A * 7/1997 Kuriyama et al. ..... 62/6
5,651,667 A 7/1997 Sand et al.
5,697,219 A * 12/1997 Nagao ..... 62/6
5,711,157 A * 1/1998 Ohtani et al. ..... 62/6
5,735,128 A * 4/1998 Zhang et al. ..... 62/6
5,737,924 A * 4/1998 Taguchi et al. ..... 62/6
5,782,096 A * 7/1998 Bartlett et al. ..... 62/55.5
5,787,712 A * 8/1998 Fukui et al. ..... 62/6
5,889,456 A 3/1999 Triebe et al.
5,901,558 A 5/1999 Matte et al.
5,956,956 A * 9/1999 Morishita et al. ..... 62/6
6,003,332 A * 12/1999 Foster ..... 62/601
6,094,912 A 8/2000 Williford
6,246,308 B1 * 6/2001 Laskaris et al. ..... 335/216
6,256,997 B1 7/2001 Longsworth
6,263,677 B1 * 7/2001 Hafner et al. ..... 62/6
6,351,954 B1 * 3/2002 Nogawa et al. ..... 62/6
6,354,087 B1 * 3/2002 Nakahara et al. ..... 62/6
6,378,312 B1 * 4/2002 Wang ..... 62/6
6,396,377 B1 * 5/2002 Ying ..... 335/300
6,397,605 B1 6/2002 Pundak
6,415,613 B1 7/2002 Ackermann et al.
6,629,418 B1 * 10/2003 Gao et al. ..... 62/6
6,662,570 B2 * 12/2003 Venkatasubramanian ..... 62/3.2
6,782,700 B1 8/2004 Unger et al.
6,902,378 B2 * 6/2005 Gaudet et al. ..... 417/27
7,000,408 B2 * 2/2006 Mitsubori ..... 62/6
7,043,909 B1 5/2006 Steele
7,114,341 B2 10/2006 Gao
7,127,901 B2 * 10/2006 Dresens et al. ..... 62/77
7,131,276 B2 * 11/2006 Pan et al. ..... 62/6
7,170,377 B2 * 1/2007 Jiang et al. ..... 335/216
7,171,811 B1 2/2007 Berchowitz et al.
7,257,949 B2 8/2007 Shimizu et al.
7,266,947 B2 9/2007 Keiter et al.
7,484,366 B2 * 2/2009 Mori ..... 60/517
2005/0028534 A1 2/2005 Li et al.
2006/0026968 A1 2/2006 Gao
2007/0107445 A1 5/2007 Boesel et al.

FOREIGN PATENT DOCUMENTS

EP 0 508 830 B1 1/1996
EP 1 241 398 A2 9/2002
WO WO 81/01190 A1 4/1981
WO WO 81/01191 A1 4/1981

* cited by examiner

LINEAR DRIVE CRYOGENIC REFRIGERATOR

RELATED APPLICATIONS

This application is a continuation of International Application No. PCT/US2009/044632, which designated the United States and was filed on May 20, 2009, published in English, which claims the benefit of U.S. Provisional Application No. 61/128,380, filed on May 21, 2008.

The entire teachings of the above applications are incorporated herein by reference.

BACKGROUND OF THE INVENTION

In prior types of cryogenic refrigerators, a working fluid, such as helium, is introduced into a cylinder, and the fluid is expanded at one end of a piston or displacer to cool a refrigeration cylinder. In Gifford-McMahon type refrigerators a high pressure working fluid is valved into a warm end of the refrigerator, and then passes through a regenerator by movement of a displacer. The fluid, cooled in the regenerator, is then expanded at the cold end of the displacer. The movement of the displacer is driven by a rotary motor.

One stage cryogenic refrigerators and two stage cryogenic refrigerators are also known. Typically, the first stage includes a first displacer. The first displacer reciprocates the working fluid between expansion and compression. The second stage includes a second displacer. The second displacer also reciprocates the working fluid between expansion and compression. Typically, the first and second displacers are interconnected and driven by a common rotary motor.

SUMMARY OF THE INVENTION

It is believed that the first and the second stages of a cryogenic refrigerator operate under different loads in practice, or namely that the stroke length, the stroke speed, stroke displacement profile, and the stroke phase of the first displacer should operate differently than the stroke length, speed, displacement profile, and phase of the second displacer. This is often discovered after the cryogenic refrigerator has been designed and put into practice. Usually, such refrigerators include a mechanical rotary drive operating both the first and the second stages. The mechanical rotary drive will operate the stages with the same stroke length, speed, displacement profile, and phase. Often it is difficult to increase the efficiency of the cryogenic refrigerator by changing operating parameters of the rotary mechanical drive. Many times, after slightly changing the operating parameters of the rotary drive to increase efficiency without success, the solution to increase an overall efficiency of the cryogenic refrigerator is to design a second new cryogenic refrigerator with different stroke parameters in mind.

Generally, the rate of stroke, the cylinder volume and temperature of the working fluid are parameters that determine the efficiency of the cryogenic refrigerator stage. This must be accomplished with the proper timing of the valves with a pressure wave to ensure that the valves open at the proper time. Generally, a problem in the art is that the second stage depends entirely from the first stage, and a second stage displacer stroke is unfortunately linked to the performance of the first stage.

The present cryogenic refrigerator is more efficient than the prior art refrigerators since the operation of the second stage is not limited by the first stage. Different operating parameters (such as stroke length and displacement profile of the displacer, displacer phase, and other displacer reciprocation parameters) for each stage can be independent and changed between the stages. This independent operation of the stages accounts for different loading of the first and the second stages without engaging in a complete redesign of the refrigerator. The cryogenic refrigerator has a first stage that independently operates relative to the second stage for improved temperature control of the cryogenic refrigerator.

According to certain embodiments of the present disclosure, there is provided a cryogenic refrigerator that has a first stage, a second stage, and a linear motor for each stage. The linear motor for each stage allows independent control of the two stages. The linear motor is operatively connected to a displacer. In another stage of the refrigerator, a second linear motor is operatively connected to a second displacer. The displacer is a piston-like element that reciprocates in a refrigeration cylinder for each stage. The linear motors control a stroke of each of the displacers.

In another embodiment, the linear motors permit operating a first displacer at a first stroke length in the first stage, and operating a second displacer at a second stroke length in the second stage. The first stroke length and the second stroke length can be different, or can be the same.

The refrigerator may be manufactured as a Gifford McMahon refrigerator, and may include a gas control valve. The valve admits high pressure helium working gas into, and a second valve exhausts the working gas out from, the refrigeration cylinder. The valves can be electric valves, mechanical valves, and can be spool valves. Valve operation may be controlled by the controller and not predefined by the motion of displacers.

The cryogenic refrigerator preferably has two linear motors with each operatively connected to a displacer for each of the first and the second stages. The linear motor can be controlled and permits operating a first displacer at a first stroke speed, stroke length, displacement profile, cyclic speed, or phase in the first stage, and operating a second displacer at a second potentially different stroke speed, length, displacement profile, cyclic speed or phase in the second stage. The stroke speed, lengths, phases, profile or cyclic speeds can also be the same, if needed.

The cryogenic refrigerator may also include a vibration damping device associated with the refrigerator. The vibration damping device removes an unwanted vibration caused by the linear motors, or removes the vibration associated with the reciprocation of the displacers. The damping device can be active or passive in nature. A position sensor may be placed on the displacers, or at another location of the cryogenic refrigerator, to measure a position of a first or a second displacer, and provide a feedback signal. The feedback signal can be received, and independent control of the first and second stages is achieved based on the feedback signal. In a further embodiment the systems can be operated open loop. In yet a further embodiment of the present disclosure, a working fluid can be introduced to the first stage, and the working fluid can be thermodynamically isolated from the working fluid of the second stage. A different working fluid can be used in each stage for increased efficiency.

The area identified on a plot of pressure versus volume defines the gross cooling generated in one cycle of the refrigerator. This is true for each stage of the refrigerator.

The rate of cooling, or the cooling generated per unit time, is this PV area divided by the time taken to make one cycle. Hence, for each stage:

$$Q_{gross} = \frac{\oint PV}{t}$$

By the perfect gas law, $$\frac{PV}{t} = \dot{M}RT$$

Thus the gross cooling Q generated at each stage is proportional to the rate at which each stage's expansion volume processes the gas, or $\dot{M}_{stage}$.

In turn, the work provided by the compressor, hence the input power is proportional to the mass flow rates $[\Sigma\dot{M}=\dot{M}_{stage1}+\dot{M}_{stage2}]$ that it supplies.

The actual, or net, cooling delivered to the application is the gross cooling reduced by the various loss mechanisms within the refrigerator itself. Some of the loss mechanisms in the refrigerator's cold head are functions of stroke and/or cyclic speed. Reducing either the stroke or speed reduces both the gross cooling as well as some of the loss mechanisms. Each user of a cryogenic refrigerator has their own specific cryogenic cooling requirements. For each stage of the cryogenic refrigerator, these can be identified as a specific load [e.g., watts] at a particular temperature. In conventional two stage cryogenic refrigerators both stages are kinematically linked, therefore sharing the same stroke and cyclic speed.

Meeting the cooling requirements of a wide number of users and a wide range of varying first and second stage head loads has traditionally meant using a cryogenic refrigerator sized to exceed the need of the users. This excess capacity either means temperatures run colder than needed or the excess is wasted by using heaters to maintain the required temperatures; both are inefficient. An oversized refrigerator also means it processes more gas than required, which translates into a need for a larger than necessary compressor. An increased refrigeration capacity may sometimes be temporarily required for one or more of the refrigeration stages. This can also be accomplished by increases in either the stroke or the cyclic speed. Thus, being able to independently control the stroke parameters and the speed of the refrigerator's stages, a wide range of specific cooling requirements can be met and with an improved system efficiency. Control also allows a system to meet short term increases in refrigeration requirements.

The refrigeration may, for example, cool cryopumping surfaces, superconductors, substrates, detectors, medical devices or any other items. Any item being cooled may be cooled through an intermediate fluid.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1A:
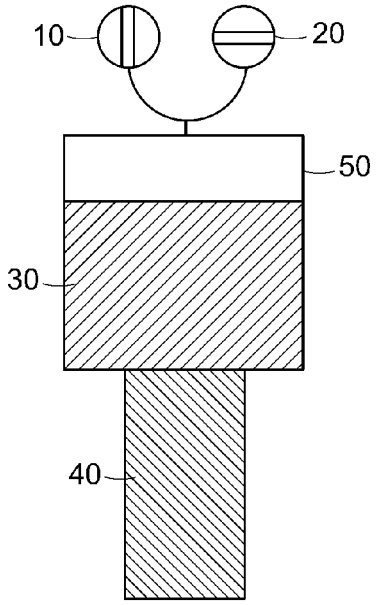
FIGS. 1A through 1D show the two displacers and valves operating according to a Gifford-McMahon cycle.
Figure 1B:
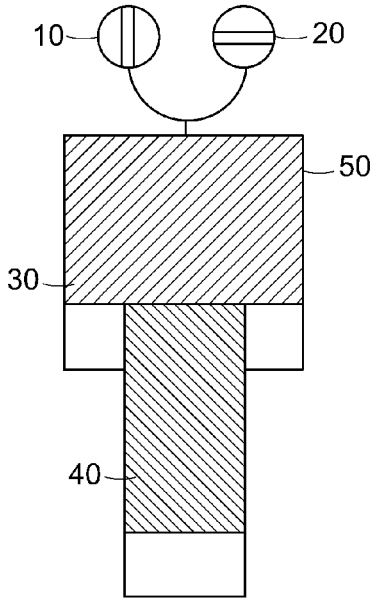
Figure 1C:
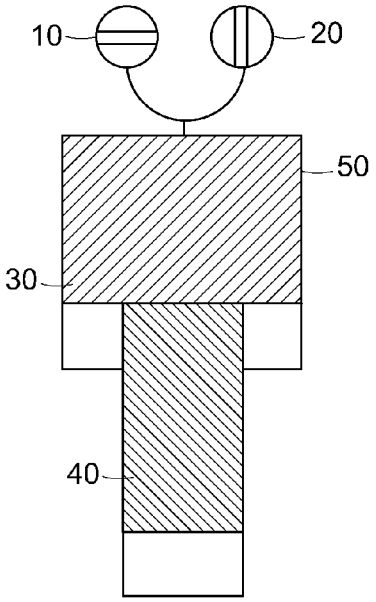
Figure 1D:
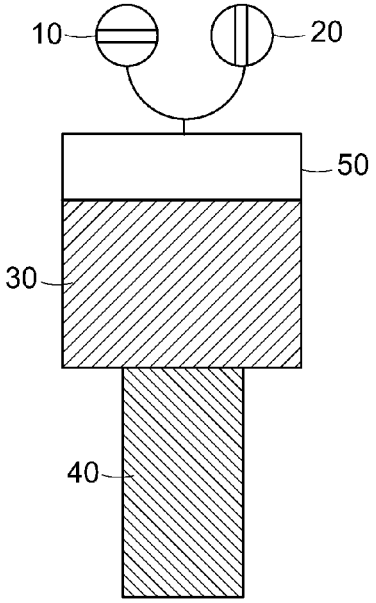

Turning FIGS. 1A through 1D, there is shown several stages of a cryogenic refrigerator that has a high pressure valve 10, and a low pressure valve 20 with a first displacer 30, and a second displacer 40 in a refrigeration cylinder 50. Preferably, in FIG. 1A, the high pressure valve 10 is opened, and the displacers 30, 40 that include a regenerative material (not shown) therein are in a lower most position in phase 1 which is minimum cold volume at bottom dead center. The high pressure working fluid fills the cylinder 50. In FIG. 1B, the working fluid is cooled by passing through the regenerator (not shown) in the displacers 30, 40, and the displacers 30, 40 move from bottom dead center to top dead center. In FIG. 1C, the high pressure valve 10 is closed, and the low pressure valve 20 is opened. The working fluid undergoes expansion, which results in the cooling effect. Turning now to FIG. 1D, the low pressure working fluid moves back through the regenerator in the displacer 30, 40, and the displacers 30, 40 move back to bottom dead center, and the working fluid is exhausted from the cylinder 50 through the low pressure valve 20. It should be noted that the opening and closing of the high pressure and low pressure valves may not perfectly align with top and bottom dead center because shifts in the relationship of displacer displacement and valve position are needed to optimize the pressure-volume diagram and cooling for each particular refrigerator.

Figure 1E:
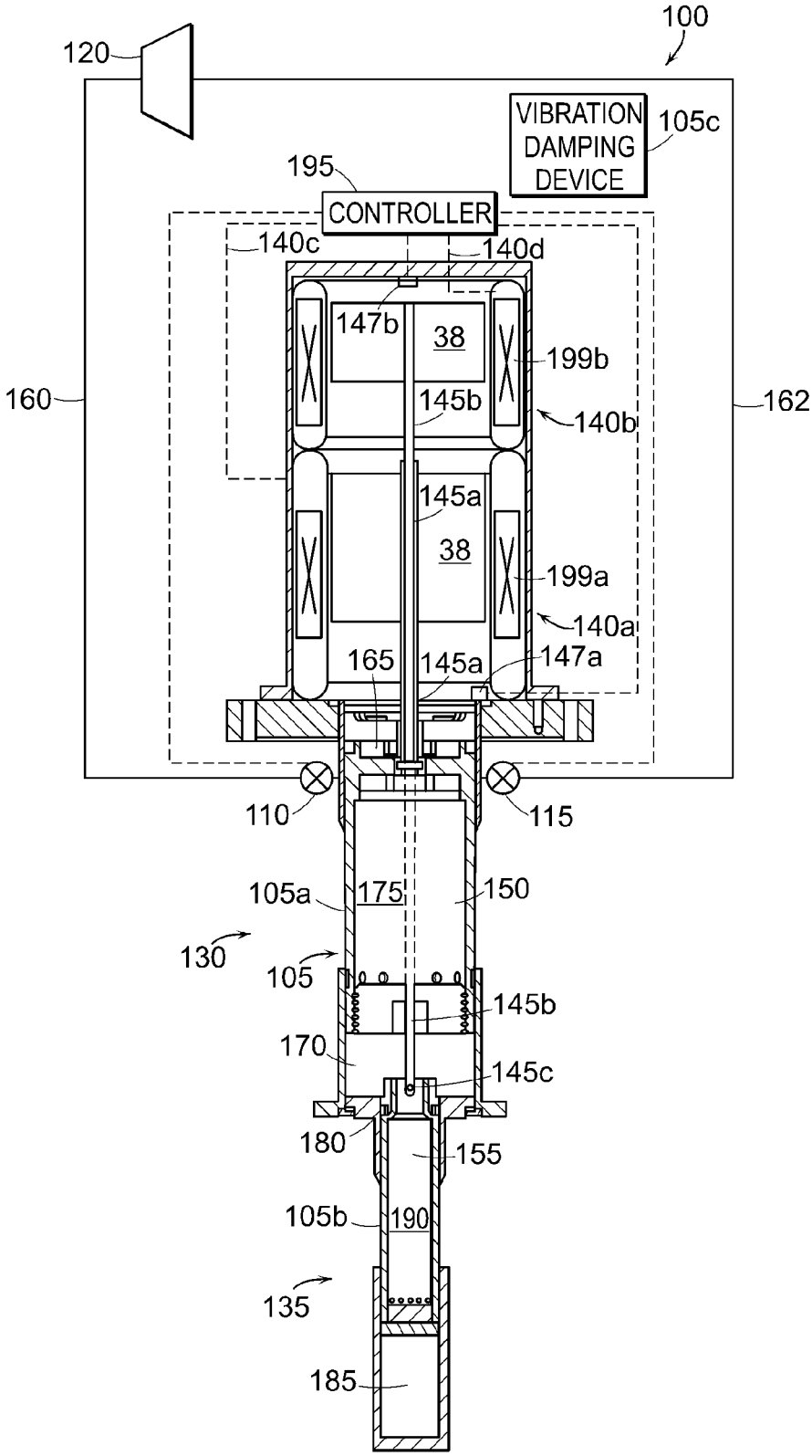
FIG. 1E shows another schematic drawing of a cryogenic refrigerator according to an embodiment of the present disclosure with a first linear motor controlling a first displacer and a second linear motor independently controlling a second displacer.

Turning now to FIG. 1E, there is shown an embodiment of the cryogenic refrigerator 100 according to the present disclosure. In this embodiment, the cryogenic refrigerator 100 includes a first motor 140*a*, and a second motor 140*b* that independently control the first displacer 150 and the second displacer 155, respectively. This permits the stroke length of the first displacer 150 to be independent and different relative to the stroke length of the second displacer 155. Additionally, the controller 195 can independently control the stroke speed of each displacer 150, 155, the stroke profile of each displacer 150,155 or the stroke phase of each displacer 150, 155 to independently control the temperature of the first and the second stages 130, 135 depending on the particular system.

Although any form of motors may be used, the motors 140*a*, 140*b* are linear motors of the moving magnet type with permanent magnets 138*a*, 138*b* and coils 199*a* and 199*b*. In an alternative embodiment, the linear motors 140*a*, 140*b* may be a system comprising pneumatic valves and a compressor (not shown) for supplying gas to the first stage displacer 150 and the second stage displacer 155. The stroke parameters of the first displacer 150 and the second displacer 155 may be controlled by timing the opening and closing of the pneumatic valves. The independent operation of the linear motors advantageously can be changed in real time without having to redesign the cryogenic refrigerator 100 for independent stage temperature control. This is advantageous to accommodate the cryogenic refrigerator 100 to different loads and conditions. Additionally, heat is not added to the first stage to establish the required operating temperature of the coldest portion of the first stage during operation and the ratio of capacity of different loads to the first and second stages is adjustable since using linear motors 140*a*, 140*b*, the refrigerator controller can selectively control differing loads.

It should be appreciated that this arrangement is not limiting, and the arrangement can be reversed, additional coaxial shafts may drive additional displacers in additional stages or the motors 140*a*, 140*b* can be positioned side by side, or in another configuration to permit driving at least two displacers 150, 155. The first motor 140*a* includes an output shaft 145*a*. The output shaft 145*a* is coupled to the first stage displacer 150 so the first motor 140*a* can control the stroke of the first displacer 150 as it reciprocates the first displacer 150 from the bottom dead center position to the top dead center position. (Here, bottom and top dead center are for the stroke length established by the controller and not the maximum possible stroke.)

The second motor 140*b* includes a second output shaft 145*b*. The second output shaft 145*b* is connected to the second stage displacer 155 by a pin joint 145*c*. The second output shaft 145*b* advantageously runs coaxially through the shaft 145*a*, and the first displacer 150 in a sealed manner. Accordingly, the second motor 140*b* can control the stroke of the second displacer 155. The second output shaft 145*b* reciprocates the second displacer 155 from the bottom dead center position to the top dead center position coaxially through the first displacer 150.

The cryogenic refrigerator 100 according to FIG. 1E preferably operates under a Gifford McMahon cycle and includes a working fluid that enters a refrigeration cylinder 105 by a high pressure valve 110 and that exits the refrigeration cylinder 105 by a low pressure valve 115. However, this embodiment is not limiting, and the refrigerator 100 may operate under other known cycles, and the Gifford McMahon cycle is merely shown as one embodiment under the present disclosure. The cryogenic refrigerator 100 also comprises a compressor 120, which communicates with the cryogenic refrigerator 100 by lines 160 and 162. Line 160 is connected to the high pressure valve 110, and line 162 is connected to the low pressure valve 115. Low pressure gas from valve 115 returns to the compressor 120 by line 162, is compressed and is delivered to valve 110 by line 160. Although shown as a single compressor unit, the compressor may also, for example, comprise parallel manifolded compressor units or allow for a variable supply of compressed gas.

The refrigeration cylinder 105 has portions 105*a* and 105*b*. Portion 105*a* defines an upper warm chamber 165 and a lower cold expansion space 170 of the first stage. The upper warm chamber 165 and the lower cold expansion space 170 are in fluid communication by a regenerative matrix 175, which is within the displacer 150, or alternatively the matrix 175 can be stationary and can be located outside of the displacer 150.

A cold expansion space 185 is also located below the second displacer 155 in second refrigerator cylinder portion 105*b*, which is the coldest portion of the refrigerator 100, and can achieve a temperature as low as about 4 Kelvin. The volume below the second displacer 155 in the second refrigeration cylinder portion 105*b*, defines the cold expansion space 185. With regard to the second displacer 155, chamber 170 and the lower cold expansion space 185 are in fluid communication by a regenerative matrix 190, which is located in the second displacer 155, or can be located in a stationary position, which is outside of, and remote from, the displacer 155. Operation of the cryogenic refrigerator 100 of FIG. 1E will now be discussed.

In operation, the first linear motor 140*a* is operatively coupled to a controller 195, along lead 140*c*. The controller may be integral with or remote from the refrigeration cylinders. The controller 195 controls the first linear motor 140*a*, and which controls reciprocation of the stroke of the first displacer 150. The controller 195 also controls the opening and the closing of the high pressure valve 110 and the low pressure valve 115 to introduce the working fluid at the correct intervals. The valves 110, 115 can be electronic valves, or can be spool valves. Additionally, mechanical valves 110, 115 may be used instead of electronic valves 110, 115. The controller 195 is also operatively coupled to the second motor 140*b* through lead 140*d*, so the controller 195 controls the second motor 140*b* and the stroke of the second displacer 155.

In operation, the high pressure valve 110 is opened. The first displacer 150 and the second displacer 155 are both in the lowermost position, bottom dead center, and helium or another suitable working fluid is introduced through a high pressure valve 110 from the compressor 120, and into the upper warm chamber 165. The high pressure working fluid fills the upper warm chamber 165 and passes into the regenerative matrix 175. The gas continues to pressurize the gas spaces in the second stage including the space above the second displacer 155, the second regenerator matrix 190 and the second expansion space 185. Next, the controller 195 controls the first motor 140*a* to reciprocate the shaft 145*a*. This moves the first stage shaft 145*a* and the first motor 140*a* drives the first displacer 150 from the bottom dead center towards the top dead center position. The displacer motion will result in the working fluid passing from the upper chamber 165 to the lower chamber or expansion space 170 of cylinder portion 105*a* through the regenerative matrix 175, with the working fluid giving off heat relative to the relatively cool matrix 175. As the fluid is cooled, the high pressure is maintained through the fluid line 160.

As the first stage displacer 150 is brought toward the top dead center position, the controller 195 then controls the second stage displacer 155, potentially with a different stroke length, stroke speed, displacement profile, and/or reciprocation phase, relative to the first stage displacer 150. This allows for a separate temperature control that is desired/required for the second stage 135. The controller 195 will control the second motor 140*b* to move the second displacer 155 by shaft 145*b*. The gas continues to move from the first stage 130 and is transferred to the second stage expansion space 185 through the second regenerative matrix 190 by the motion of second displacer 155.

It should be appreciated that the cycle rate of each displacer can be potentially the same, but how fast each displacer 150, 155 moves during the cycle can be potentially different. High pressure valve 110 remains open during at least part of the transit of the displacers towards the warm end to ensure sufficient gas to expand.

The first displacer 150 and second displacer 155 will then approach or reach the top dead center position and high pressure valve 110 is closed. The gas in expansion spaces 170, 185 undergoes expansion, as the low pressure valve 115 is opened, which results in the cooling effect.

Now with the low pressure valve 115 open, the controller 195 controls the first linear motor 140*a* and the second linear motor 140*b* to move, independently, the first and the second displacers 150, 155 from the top dead center position downwardly to the bottom dead center position, thereby moving the working fluid from the expansion spaces 170, and 185 upwardly through the low pressure valve 115 to the line 162 to expel the working fluid. Thereafter, the above described cycle repeats. Again, it should be noted that the opening and closing of the valves may not occur precisely at the extremes of displacement due to the need to optimize the pressure-volume diagram and cooling for the particular refrigerator.

It should be appreciated that the independent operation of the first and the second displacers 150, 155 can achieve independent temperature control of the first and the second stages 130, 135. An issue during operation is that the independent reciprocation of the first and the second motors 140*a*, 140*b* (and the coaxially disposed output shafts 145*a*, 145*b* reciprocating at different times) can cause an unwanted vibration that is transmitted to the cylinder 105, and other structures nearby. Therefore, the present cryogenic refrigerator 100 preferably includes a dynamic balancing device 105*c* to remove an unwanted vibration or to otherwise dampen the vibration caused in part by the displacer's 150 or 155 reciprocation and/or by operation of the first and the second motors 140*a*, 140*b*.

The damping device 105*c* preferably is operatively connected to the refrigeration cylinder 105, or at another suitable location. The damping device 105*c* can be an active damping device or a passive damping device 105*c*. The active damping device 105*c* preferably can induce another second corrective vibration to cancel out the unwanted vibration. This actively cancels out the unwanted vibration resulting in little or no overall vibration to the mounting flange 148. The passive damping device 105*c* preferably comprises a measured weight that is fastened to the refrigeration cylinder 105 at a desired location so as to remove the unwanted vibration. Preferably, the damping device 105*c*, is a heavy weight that surrounds the cylinder 105, or a portion thereof, in a coaxial manner.

A position sensor 147*a*, 147*b* may further monitor the position of one or both of the first and the second displacers 150, 155, and communicate respective feedback signals to the controller 195. Position sensor transducers can be placed on each shaft, each displacer, or on any component that moves upwardly or downwardly or that senses such movement. Position sensors can be within the linear motor as well. Position sensing can also be obtained from the motor, for example, monitoring motor power or back EMF. The controller 195, upon receiving these feedback signals, may then further independently control the first and the second stages 130, 135 according to the received feedback signals for temperature control or corrections of the first and the second stages 130, 135. In one embodiment, the sensor may comprise a Hall effect position transducer element.

Figure 1F:
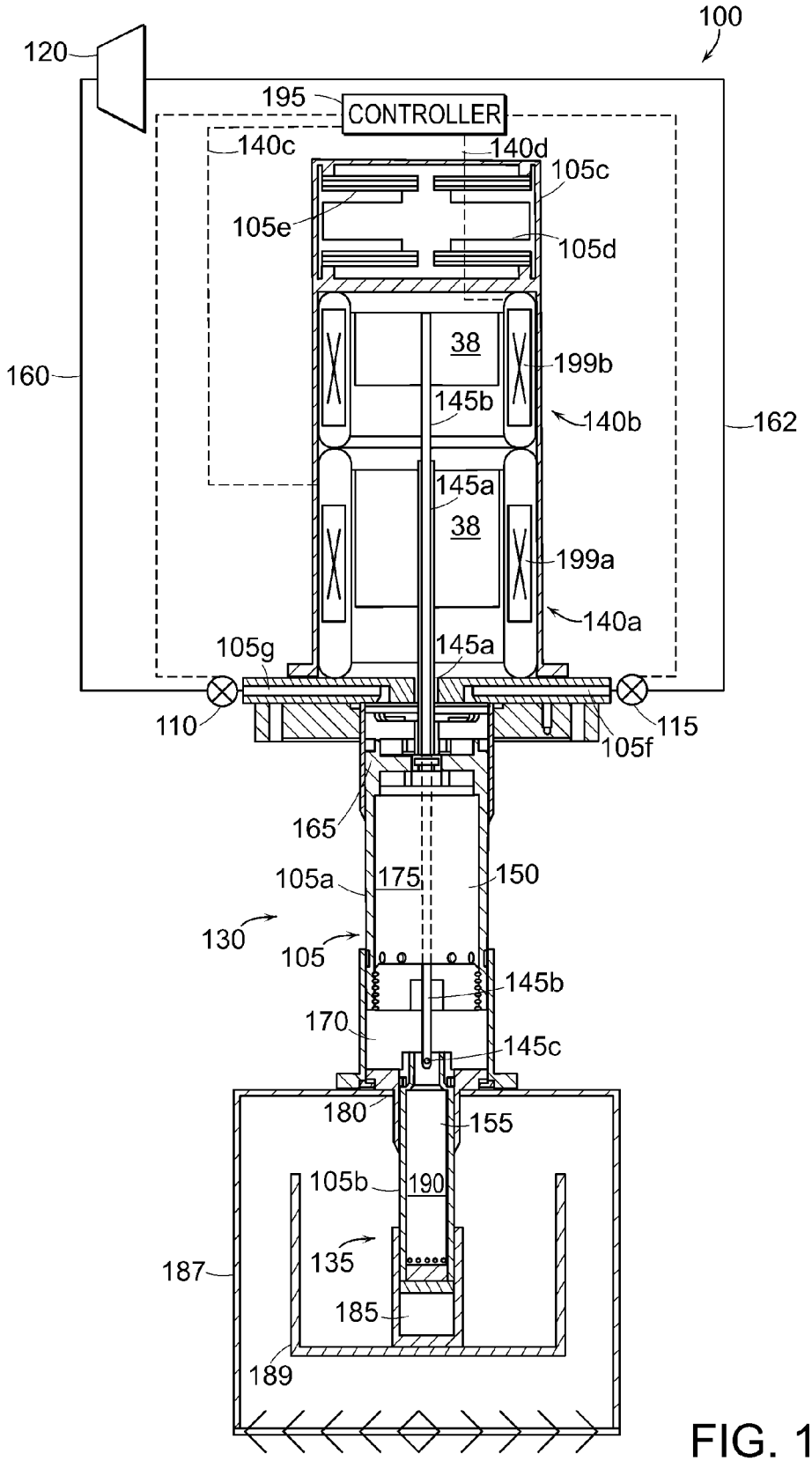
FIG. 1F shows the refrigerator having a passive dynamic balancer.
Figure 2:
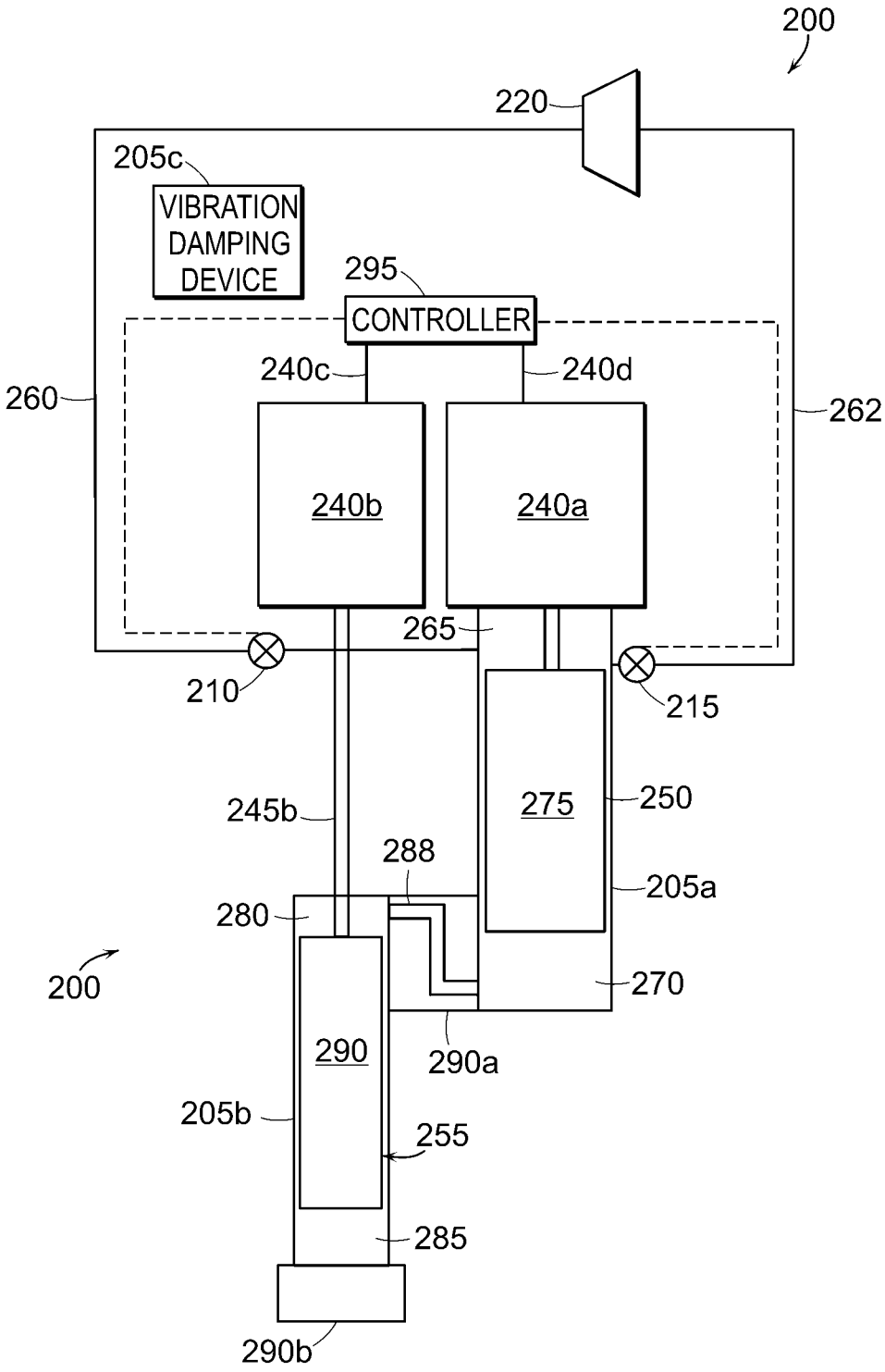
FIGS. 2-3 show further schematic drawings of cryogenic refrigerators according to further embodiments of the present disclosure.
Figure 3:
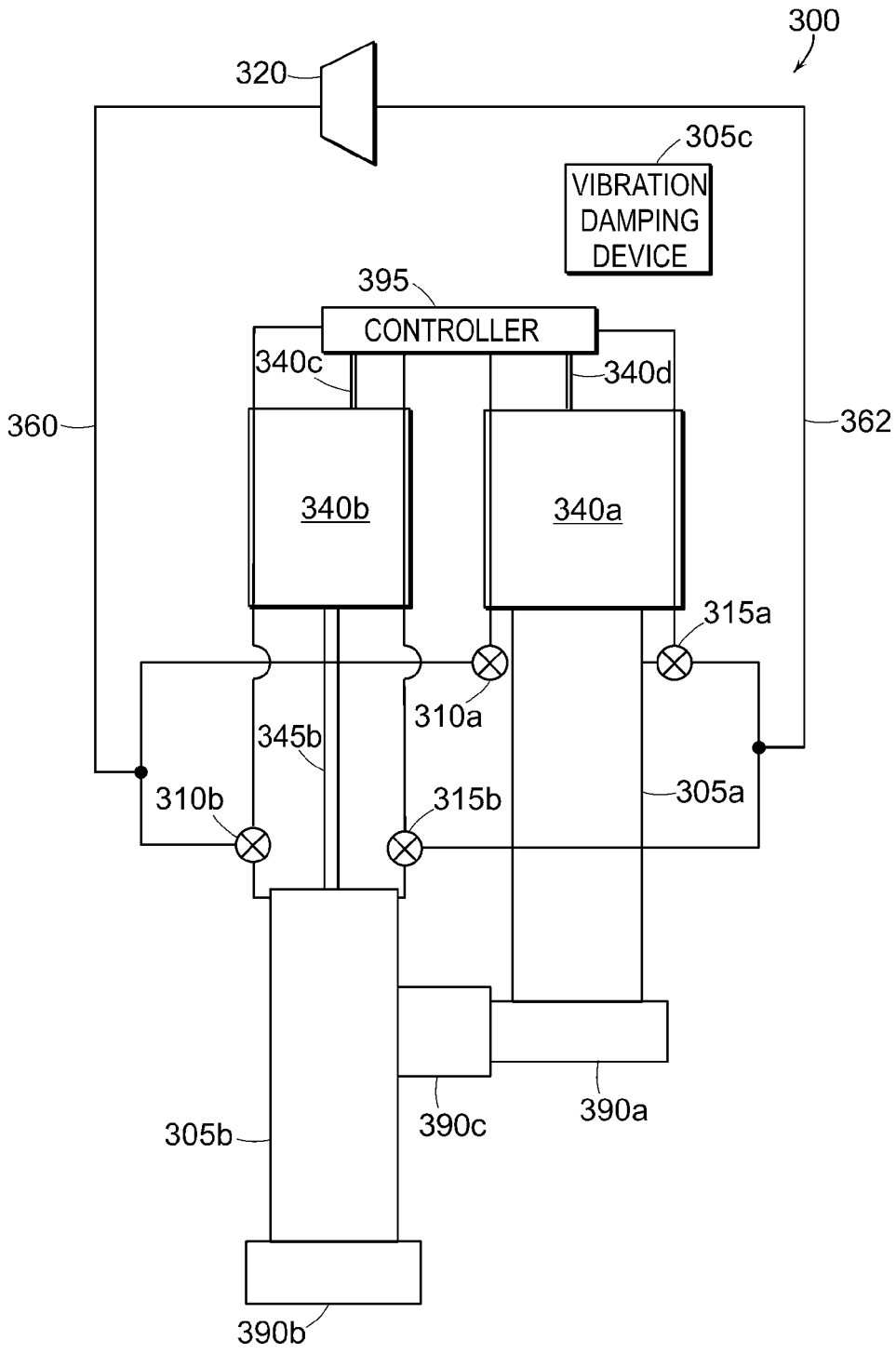

Turning to FIG. 1F, there is shown a refrigerator 100, having the passive damping device 105*c*, and also shown as 205C in FIGS. 2, and 305C in FIG. 3, with a number of weights 105*d* connected by a flexural joint 105*e* to cancel a vibration by vibrating in anti-phase to the linear motors. Additionally, tubing 105*f* and 105*g* are shown to introduce a refrigerant (helium) into and from the cylinder 105 through valves 110 and 115. The refrigerator of FIG. 1F is also shown cooling cyropumping surfaces in a cryogenic vacuum pump (cryopump). The first stage cools a radiation shield 187 and the second stage cools a low temperature condensing and adsorption cryopanel 189. Any conventional cryopanel configuration may be cooled by the refrigerator. The refrigerator may alternatively be used in any known cryogenic application, including cooling of superconductors. Turning now to FIG. 2, there is shown another embodiment of the present disclosure. In this embodiment, the cryogenic refrigerator 200 is again shown as a Gifford McMahon refrigerator with a high pressure valve 210 and a low pressure valve 215. The high pressure valve 210 communicates with a line 260, which communicates with a compressor 220. Compressor 220 provides a working fluid, such as helium, to the cryogenic refrigerator 200 through the valve 210. However, it should be appreciated that this Gifford McMahon cycle is not limiting, and the present invention may encompass other cycles known in the art.

In the embodiment shown in FIG. 2, the second linear motor 240*b* is positioned differently relative to the embodiment of FIG. 1E. Here, the second linear motor 240*b* is disposed adjacent to the first linear motor 240*a*. The output shaft 245*b* associated with the second linear motor 240*b* is not coaxially disposed through the first displacer 250 to connect to the second displacer 255. In this embodiment, the second shaft 245*b* (associated with the second linear motor 240*b*) is placed adjacent to the first displacer 250.

In this embodiment, preferably, a cryogenic refrigerator 200 includes a first linear motor 240*a* connected to a first displacer 250 that is housed in a first refrigeration cylinder 205*a*. The first refrigeration cylinder 205*a* includes a warm upper chamber 265 and a cold expansion space 270. The first displacer 250 also includes a regenerative material 275 as previously described. Preferably, the expansion space 270 communicates with a flow path 288 in a first stage heat station 290*a*, which communicates with the second stage refrigeration cylinder 205*b* and second displacer 255.

The cryogenic refrigerator 200 also includes the second linear motor 240*b*. Second linear motor 240*b* is connected to the second displacer 255 by second shaft 245*b*, which is housed in the second refrigeration cylinder 205*b*. Second refrigeration cylinder 205*b* is connected to the first stage heat station 290*a*. The second refrigeration cylinder 205*b* defines a space 280 and a cold expansion space 285. The cold expansion space 285 is located below the second displacer 255. The second displacer 255 also includes a regenerative material 290 inside the second displacer 255.

In operation, the high pressure valve 210 is opened. The first and second displacers 250 and 255 are in the lowermost position, bottom dead center, and helium or another suitable working fluid is introduced through a high pressure valve 210. Working fluid traverses from the compressor 220 into the upper warm chamber 265 of the first refrigeration cylinder 205*a*.

The high pressure working fluid fills the upper warm chamber 265 and the regenerative matrix 275 of the first displacer 250, heat station path 288, space 280, regenerator matrix 290 of second displacer 255 and expansion space 285 and the working fluid gives off heat relative to the cool regenerative matrices 275 and 290. As the fluid is cooled, the high pressure is maintained through the fluid line 260. Next, the controller 295 controls the first motor 240*a* to reciprocate first shaft 245*a* which is connected to the first displacer 255. The first motor 240*a* drives the first displacer 250 from the bottom dead center upwardly towards the top dead center. The pressurized gas moves through both regenerator matrices and is cooled by the heat exchange with the regenerator matrices.

Turning now to the second stage, the second displacer 255 is connected to the second linear motor 240*b* by output shaft 245*b*, which is located adjacent to the first refrigeration cylinder 205*a*. The second linear motor 240*b* moves the second displacer 255 from the bottom dead center toward the top dead center at potentially a different speed, stroke length, stroke profile or reciprocating phase relative to the stroke of the first displacer 250.

As both first displacer 250 and second displacer 255 approach top dead center position, high pressure valve 210 is closed and the gas undergoes an expansion as low pressure valve 215 is opened. As the first displacer 250 is brought to the top dead center position, the controller 295 simultaneously controls the second stage with potentially a different stroke length, stroke speed, stroke profile or stroke phase relative to the first stage, and depending on the desired temperature for the second stage. The controller 295 controls the second motor 240*b*, which is placed adjacent to the first stage linear motor 240*a*, to move the second displacer 255.

The working fluid, which is in the cold expansion spaces 285 and 270, is expanded once the low pressure valve 215 is opened, and the resulting cooling effect is achieved. Next, the refrigeration cylinders 205*a*, 205*b* are exhausted. The controller 295 controls the first linear motor 240*a* and the second linear motor 240*b* to move the first and the second displacers 250, 255 from the top dead center position downwardly to the bottom dead center position. This movement drives the working fluid from the expansion space 270 and 285 through the displacers to the line 262 to return the working fluid to the compressor 220. It should be appreciated that the independent operation of the first and the second displacers 250, 255 can achieve independent temperature control of the first and the second stages.

Turning now to another embodiment shown in FIG. 3, preferably instead of the first stage heat station 290*a* of FIG. 2 acting as a gas passage to the second stage refrigeration cylinder 305*b*, the first stage heat station 390*a* may be fluid isolated from the second refrigeration cylinder 305*b*, and instead a thermal conduction block 390*c* may be introduced between the cylinders 305*a*, 305*b* to thermally link the two stages yet isolate the first stage working fluid from the second stage working fluid. Here, the cryogenic refrigerator 300 may include a second high pressure valve 310*b* and a second low pressure valve 315*b* to introduce and exhaust the working fluid from the second refrigeration cylinder 305*b* so the first stage fluid is isolated and independent relative to the working fluid of the second stage. This is advantageous to achieve temperature control of both stages with high efficiency, as now each cylinder can have independent valve activation and potentially independent cyclic speed.

While this invention has been particularly shown and described with references to example embodiments thereof, it will be understood by those skilled in the art that various changes in form and details may be made therein without departing from the scope of the invention encompassed by the appended claims

What is claimed is:

1. A cryogenic refrigerator comprising:

a first stage;

a second stage;

gas control valves for admitting high pressure gas into and for exhausting the gas from the first and second stages; and a first linear motor connected to a first displacer for the first stage and a second linear motor connected to a second displacer for the second stage, the first and second linear motors allowing independent control of the first and second displacers.

2. The cryogenic refrigerator of claim 1, wherein the linear motors permit (i) operating the first displacer at a first stroke in the first stage, and (ii) operating the second displacer at a second stroke in the second stage.

3. The cryogenic refrigerator of claim 1, further comprising a gas control valve for admitting high pressure gas into, and a second gas control valve for exhausting the gas from the first and second stages.

4. The cryogenic refrigerator of claim 1, wherein the linear motors permit operating the first displacer at a first stroke length in the first stage, and operating the second displacer at a second stroke length in the second stage.

5. The cryogenic refrigerator of claim 1, wherein the linear motors permit operating the first displacer at a first stroke displacement profile in the first stage, and operating the second displacer at a second stroke displacement profile in the second stage.

6. The cryogenic refrigerator of claim 1, wherein the linear motors permit operating the first displacer at a first stroke speed in the first stage, and operating the second displacer at a second stroke speed in the second stage.

7. The cryogenic refrigerator of claim 1, further comprising a damping device associated with the refrigerator to remove a vibration.

8. The cryogenic refrigerator of claim 7, wherein the damping device is active.

9. The cryogenic refrigerator of claim 1, further comprising a position sensor to measure a position of at least the first or the second displacer.

10. The cryogenic refrigerator of claim 1, further comprising a working fluid introduced to the first stage, and wherein the working fluid of the first stage is blocked from the working fluid of the second stage.

11. The cryogenic refrigerator as claimed in claim 1 wherein the first and second linear motors are electromagnetic motors.

12. The cryogenic refrigerator of claim 1, wherein the cryogenic refrigerator is a Gifford McMahon two stage refrigerator.

13. A cryogenic refrigerator comprising:

a first stage refrigeration cylinder;

a first displacer, reciprocating in the first stage refrigeration cylinder, that displaces refrigeration gas between opposite ends of the first stage refrigeration cylinder;

a first regenerator that cools the displaced refrigeration gas of the first stage refrigeration cylinder;

a first linear motor, operatively connected to the first displacer, that drives the first displacer in reciprocating movement;

a second stage refrigeration cylinder;

a second displacer that displaces refrigeration gas between opposite ends of the second stage refrigeration cylinder;

a second regenerator that cools the refrigeration gas of the second stage refrigeration cylinder;

a second linear motor, operatively connected to the second displacer, that drives the second displacer in reciprocating movement;

at least one position sensor to determine a position of the first or the second displacer;

gas control valves that admit high pressure gas into and exhaust the gas from the first and second stage refrigeration cylinders; and a controller, operatively connected to the at least one position sensor and to the first and the second linear motors, that controls the first and second linear motors in an independent manner.

14. The cryogenic refrigerator of claim 13, wherein the controller controls stroke parameters of the first and the second displacer during reciprocation in response to an output from the position sensor.

15. The cryogenic refrigerator of claim 13, wherein the controller independently controls stroke parameters of the first and the second displacer during reciprocation in response to an output from the position sensor.

16. The cryogenic refrigerator of claim 13, wherein the second linear motor is connected to the second displacer coaxially through the first displacer.

17. The cryogenic refrigerator of claim 13, wherein the second linear motor is connected to the second displacer by an output shaft that is arranged adjacent relative to the first displacer.

18. The cryogenic refrigerator of claim 13, wherein the controller controls temperature of a first stage by controlling the first linear motor.

19. The cryogenic refrigerator of claim 13, wherein the controller controls temperature of a second stage by controlling the second linear motor independently relative to the first stage.

20. The cryogenic refrigerator of claim 13, wherein the controller controls temperature of a second stage by controlling independently varying the stroke profile and length of the second linear motor relative to the first linear motor.

21. The cryogenic refrigerator of claim 13, further comprising a damping device to remove a vibration.

22. The cryogenic refrigerator of claim 21, wherein the damping device is active.

23. The cryogenic refrigerator of claim 13, wherein the controller varies at least one of stroke length, stroke speed, and stroke phase of the first or the second displacers.

24. The cryogenic refrigerator as claimed in claim 13 wherein the first and second linear motors are electromagnetic motors.

25. The cryogenic refrigerator of claim 24, wherein the cryogenic refrigerator is a Gifford McMahon two stage refrigerator.

26. A method of operating a two stage cryogenic refrigerator comprising:

providing at least two displacers in the same or different refrigeration cylinders;

valving gas into and from the at least two displacers; and controlling temperature by independently controlling the at least two displacers.

27. The method of claim 26, further comprising removing a vibration associated with the two stage cryogenic refrigerator.

28. The method of claim 27, further comprising actively removing the vibration.

29. The method of claim 27, further comprising passively removing the vibration.

30. The method of claim 26, further comprising independently controlling at least one displacer to vary displacer stroke parameters relative to a second displacer.

31. The method of claim 26, further comprising independently controlling at least one displacer to vary displacer speed relative to a second displacer.

32. The method of claim 26, further comprising independently controlling at least one displacer to vary displacer phase relative to a second displacer.

33. The method of claim 26, further comprising independently controlling temperature of the two stages by independently varying a reciprocation parameter of at least one displacer relative to a second displacer.

34. The method of claim 26, further comprising sensing a position of at least one of the two displacers.

35. The method of claim 34, further comprising independently controlling the two stages in response to the position of at least one of the displacers.

36. The method of claim 26 wherein the refrigerator cools cryopumping surfaces.

37. The method of claim 26 wherein the refrigerator cools a semiconductor.

38. The method of claim 26, wherein the displacers are controlled by electromagnetic motors.

39. The method of claim 26, wherein the cryogenic refrigerator is a Gifford McMahon two stage refrigerator.

40. A cryogenic refrigerator comprising:

a first stage;

a second stage; and means for independently controlling variables of the two stages, the variables comprising at least one of stroke length, cycle rate of the refrigerator, speed of displacers, and a time when valves are operated relative to a position of the displacers.

41. The cryogenic refrigerator of claim 1 wherein the first and second linear motors comprise pneumatic valves that control stroke parameters of the displacers.

* * * * *